US007913711B2

(12) United States Patent
Milano, Jr. et al.

(10) Patent No.: US 7,913,711 B2
(45) Date of Patent: Mar. 29, 2011

(54) DOOR ASSEMBLY FOR USE IN A SHELTER AND A SHELTER INCLUDING SAME

(75) Inventors: Arthur J. Milano, Jr., Burlington, CT (US); James Grevas, Oakville, CT (US)

(73) Assignee: Shelterlogic LLC, Watertown, CT (US)

( * ) Notice: Subject to any disclaimer, the term of this patent is extended or adjusted under 35 U.S.C. 154(b) by 22 days.

(21) Appl. No.: 12/180,766

(22) Filed: Jul. 28, 2008

(65) Prior Publication Data

US 2010/0018560 A1 Jan. 28, 2010

(51) Int. Cl.
*E04H 15/58* (2006.01)
*E04H 15/02* (2006.01)
*A47H 1/00* (2006.01)

(52) U.S. Cl. ..... 135/117; 135/96; 135/903; 160/24

(58) Field of Classification Search ..... 135/87, 135/91, 96, 117, 903; 160/238, 239, 240, 160/266, 274, DIG. 8, DIG. 10, 24
See application file for complete search history.

(56) References Cited

U.S. PATENT DOCUMENTS

| | | | | |
|---|---|---|---|---|
| 3,211,211 | A | 10/1965 | Youngs | |
| 3,299,944 | A | 1/1967 | Gossling et al. | |
| 3,306,344 | A | 2/1967 | Youngs | |
| 3,398,779 | A | 8/1968 | Kuss | |
| 3,460,602 | A | 8/1969 | Hugus | |
| 3,580,323 | A | 5/1971 | Gossling et al. | |
| 3,599,651 | A | 8/1971 | Perry | |
| 3,690,078 | A | 9/1972 | Maynard, Jr. | |
| 3,749,107 | A | 7/1973 | Laberge | |
| 3,878,879 | A | 4/1975 | Manns | |
| 4,231,289 | A | 11/1980 | Domicent | |
| 4,619,305 | A | 10/1986 | Comeau | |
| 4,834,128 | A | 5/1989 | Burgess | |
| 4,986,037 | A | 1/1991 | Jackson, Jr. | |
| 5,579,820 | A * | 12/1996 | LePage et al. | 160/268.1 |
| 5,613,543 | A * | 3/1997 | Walton | 160/265 |

FOREIGN PATENT DOCUMENTS

| | | |
|---|---|---|
| CA | 0189373 | 4/1919 |
| CA | 1081111 | 7/1980 |
| CA | 1081112 | 7/1980 |
| CA | 1178882 | 12/1984 |
| CA | 2051998 | 3/1993 |
| DE | 43 11 820 C1 | 6/1994 |
| EP | 0 370 550 | 5/1990 |
| EP | 0 440 546 A1 | 8/1991 |
| GB | 2 200 157 A | 7/1988 |
| JP | 03-081490 | 4/1991 |

* cited by examiner

*Primary Examiner* — David Dunn
*Assistant Examiner* — Danielle Jackson
(74) *Attorney, Agent, or Firm* — Carmody & Torrance LLP

(57) ABSTRACT

A door assembly for use in a shelter, wherein the shelter comprises an outer frame assembly comprising a plurality of intercoupled members forming a coverable structure and a cover for covering the outer frame assembly, wherein the door assembly comprises a door frame comprising a plurality of intercoupled members; and a retractable door arrangement coupled to the door frame, wherein the retractable door arrangement comprises a door comprised of flexible material that can be extended to enclose the shelter or retracted to provide an opening into the shelter; wherein the door assembly does not rigidly connect to the outer frame assembly of the shelter during normal usage thereof. In addition, a shelter system comprising the outer frame assembly, the cover and a door frame comprising a plurality of intercoupled members and a retractable door arrangement is also provided.

16 Claims, 8 Drawing Sheets

28
14
30
28
14
18

30
28
22b
22
21
26
16
12
24
20

21
16
12
20

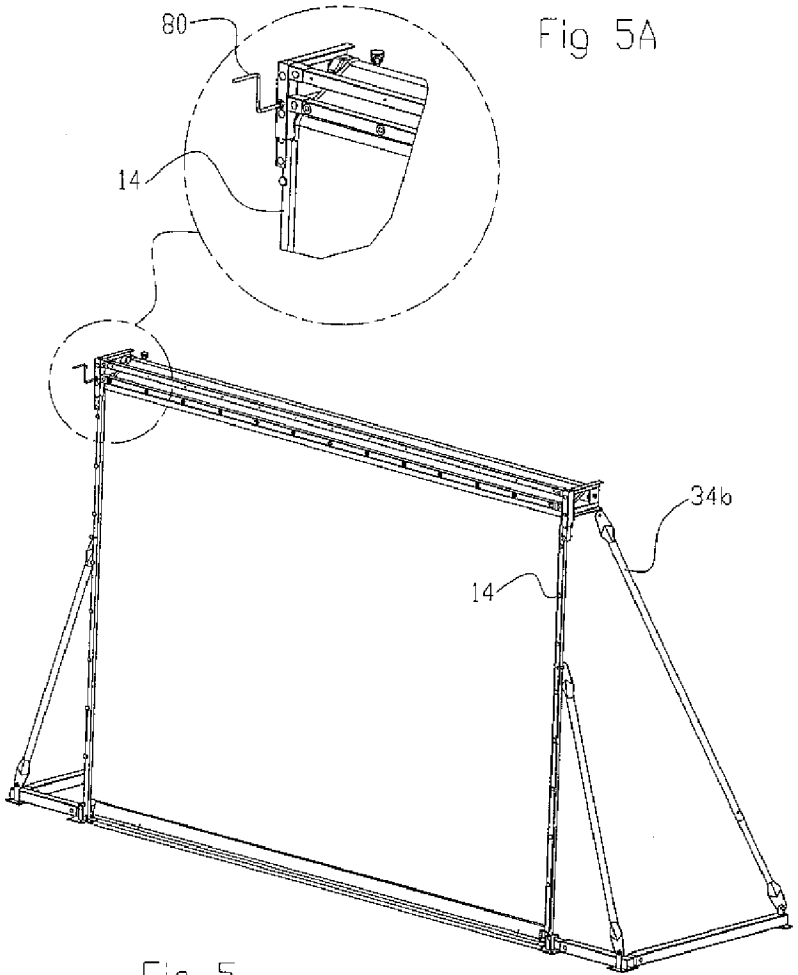
Fig 5A
Fig 5
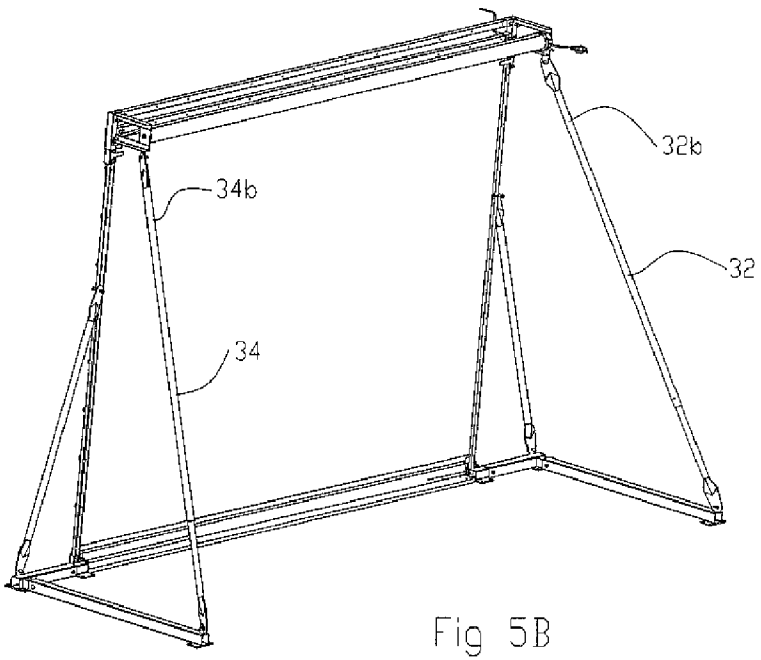
Fig 5B

DOOR ASSEMBLY FOR USE IN A SHELTER AND A SHELTER INCLUDING SAME

BACKGROUND OF THE INVENTION

The present invention relates generally to door assemblies for shelter structures and shelter structures including door assemblies, and in particular, to an improved door assembly and shelter including such a door assembly in which the door assembly is constructed to be essentially free standing (i.e. otherwise free of any rigid connection to the outer frame of the shelter). Such a construction is an improvement over the prior art for several reasons, including but not limited to, the ability to maintain satisfactory alignment of the door assembly and to permit extension and retraction of the flexible material comprising the door, as well as to improve adjustability to accommodate for varying ground and/or surface conditions.

Shelter structures with and without door assemblies are known. One such example of a shelter structure with a door is described and illustrated in Canadian Patent No. 2,051,998. However, it is believed that the shelter door system described and illustrated in this '998 patent has deficiencies. As but one example, it is believed that a door assembly that is rigidly connected to the outer frame will tend to more easily torque, thereby preventing smooth retraction and extension of the door itself during all conditions.

The foregoing problem may occur most frequently during conditions that may tend to twist, bend or degrade the structural integrity of the shelter, such as during windy conditions that act upon the constructed structure or conditions that result in variances (in surface make-up or height) of the ground, thereby resulting in what would be an undesirable twisting or torquing of the door assembly and preventing or reducing the likelihood of the door from retracting or extending efficiently and/or properly. Surely other conditions may also play a part in exacerbating this twisting or torque problem, but the problems themselves are not material to the present invention. What is material to the present invention is a construction, arrangement and method to reduce and/or eliminate such undesirable consequences, among other objectives.

Thus, it is believed that further advances in the art are desirable. For example, it would be desirable and advantageous to design a door assembly and shelter that utilizes such a door assembly that reduces and/or eliminates the aforementioned twisting and/or torquing of the door assembly. In addition, it would be desirable and advantageous to provide all of the foregoing in a tubular structure that is not overly expensive to manufacture and is reasonably priced to consumers, all while overcoming the aforementioned deficiencies and achieving the aforementioned and below mentioned objectives.

SUMMARY AND OBJECTIVES OF THE PRESENT INVENTION

It is thus an objective of the present invention to overcome the perceived deficiencies in the prior art.

For example, it is an objective of the present invention to provide an improved door assembly for shelter structures and shelter structures including such a door assembly that reduces and/or eliminates the problem of twisting and/or torquing of the door assembly, thereby improving the ability of the door to retract and/or extend efficiently and properly.

It is yet another objective of the present invention to provide an improved door assembly for shelter structures and shelter structures including such a door assembly that can be used on a variety of ground conditions, such as during winter and/or on less than perfectly flat ground.

It is yet another objective to provide a method of constructing an improved door assembly for shelter structures and shelter structures including such a door assembly that is easy to assemble.

Another objective of the present invention to provide an improved door assembly for shelter structures and shelter structures including such a door assembly with a door that can be retracted or extended during a power outage.

It is yet another objective of the present invention to provide an improved door assembly for shelter structures and shelter structures including such a door assembly that is durable.

Still further, it is an objective of the present invention to provide an improved door assembly for shelter structures and shelter structures including such a door assembly that provides for improved stability and structural integrity.

It is yet another objective of the present invention to provide an improved door assembly for shelter structures and shelter structures including such a door assembly that allows for relatively quick assembly and disassembly, while at the same time, achieving the other objectives set forth herein.

Yet another objective of the present invention is to provide an improved door assembly for shelter structures and shelter structures including such a door assembly that is both easy to utilize and manufacture and also that achieves all of the advantages and objectives set forth herein.

Further objects and advantages of this invention will become more apparent from a consideration of the drawings and ensuing description.

The invention accordingly comprises the features of construction, combination of elements, arrangement of parts and sequence of steps which will be exemplified in the construction, illustration and description hereinafter set forth, and the scope of the invention will be indicated in the claims.

To overcome the perceived deficiencies in the prior art and to achieve the objects and advantages set forth above and below, the present invention is, generally speaking, directed in a first embodiment to a door assembly for use in a shelter, wherein the shelter comprises an outer frame assembly comprising a plurality of intercoupled members forming a coverable structure and a cover for covering the outer frame assembly, wherein the door assembly comprises a door fame comprising a plurality of intercoupled members; and a retractable door arrangement coupled to the door frame, wherein the retractable door arrangement comprises a door comprised of flexible material that can be extended to enclose the shelter or retracted to provide an opening into the shelter; wherein the door assembly does not rigidly connect to the outer frame assembly of the shelter during normal usage thereof.

In another preferred embodiment a shelter system is provided. In this preferred embodiment, the shelter system comprises an outer frame assembly comprising a plurality of intercoupled members forming a coverable structure; a cover for covering the outer frame assembly; a door frame comprising a plurality of intercoupled members; and a retractable door arrangement coupled to the door frame, wherein the retractable door arrangement comprises a door comprised of flexible material that can be extended to enclose the shelter or retracted to provide an opening into the shelter; wherein the door assembly does not rigidly connect to the outer frame assembly of the shelter during normal usage thereof.

BRIEF DESCRIPTION OF THE DRAWINGS

The above set forth and other features of the invention are made more apparent in the ensuing Description of the Preferred Embodiments when read in conjunction with the attached Drawings, wherein:

FIG. 5 is another perspective view of the door assembly constructed in accordance with a preferred embodiment of the present invention, showing the door in the extended position;

FIG. 5A is a perspective close up view of a section of the door assembly of FIG. 5;

FIG. 5B is a rear perspective view of the door assembly of FIG. 5;

Identical reference numerals in the figures are intended to indicate like parts, although not every feature in every figure may be called out with a reference numeral.

DETAILED DESCRIPTION OF THE PREFERRED EMBODIMENTS

Figure 1:
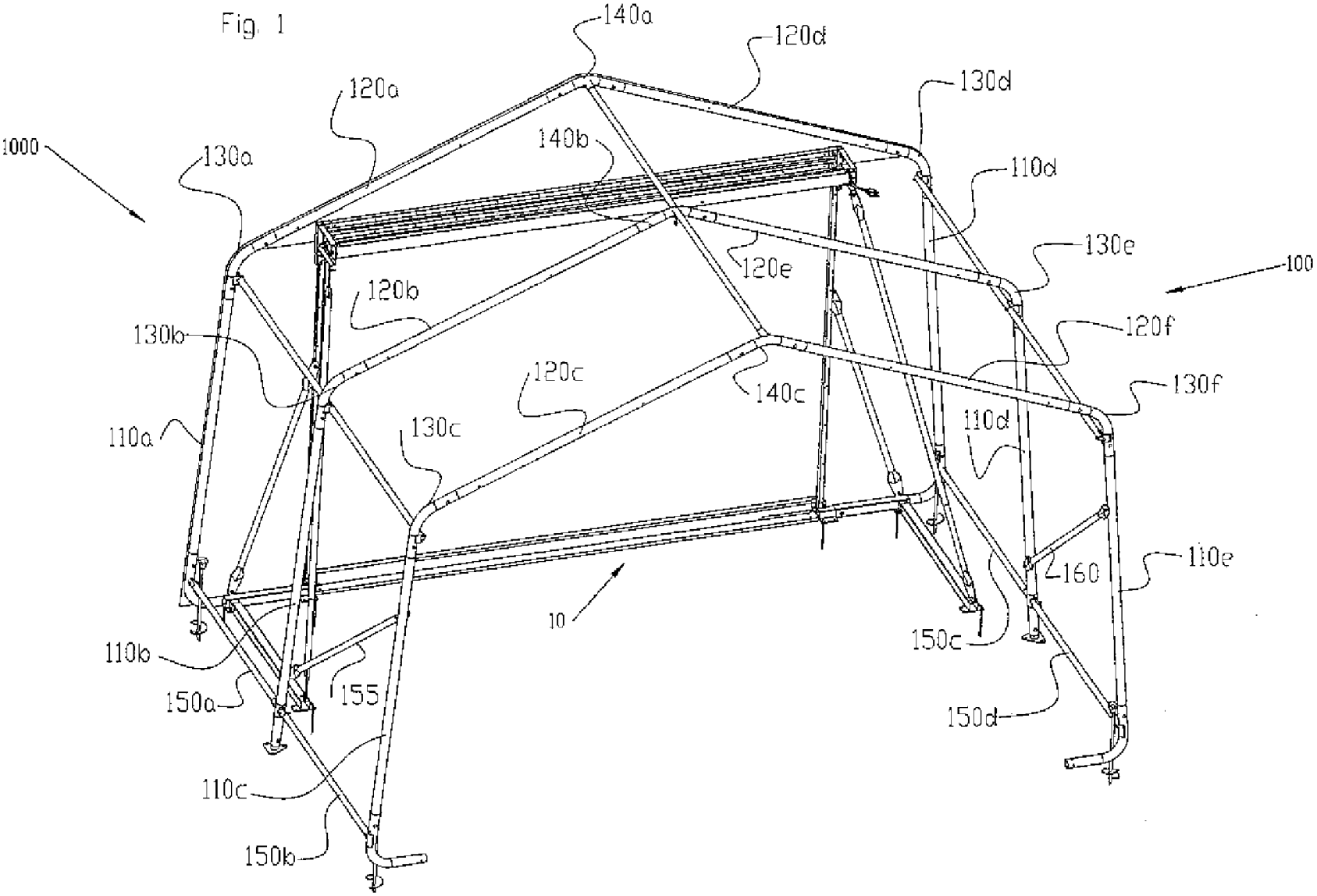
FIG. 1 is a perspective view of the combination shelter structure and door assembly constructed in accordance with a preferred embodiment of the present invention.
Figure 2:
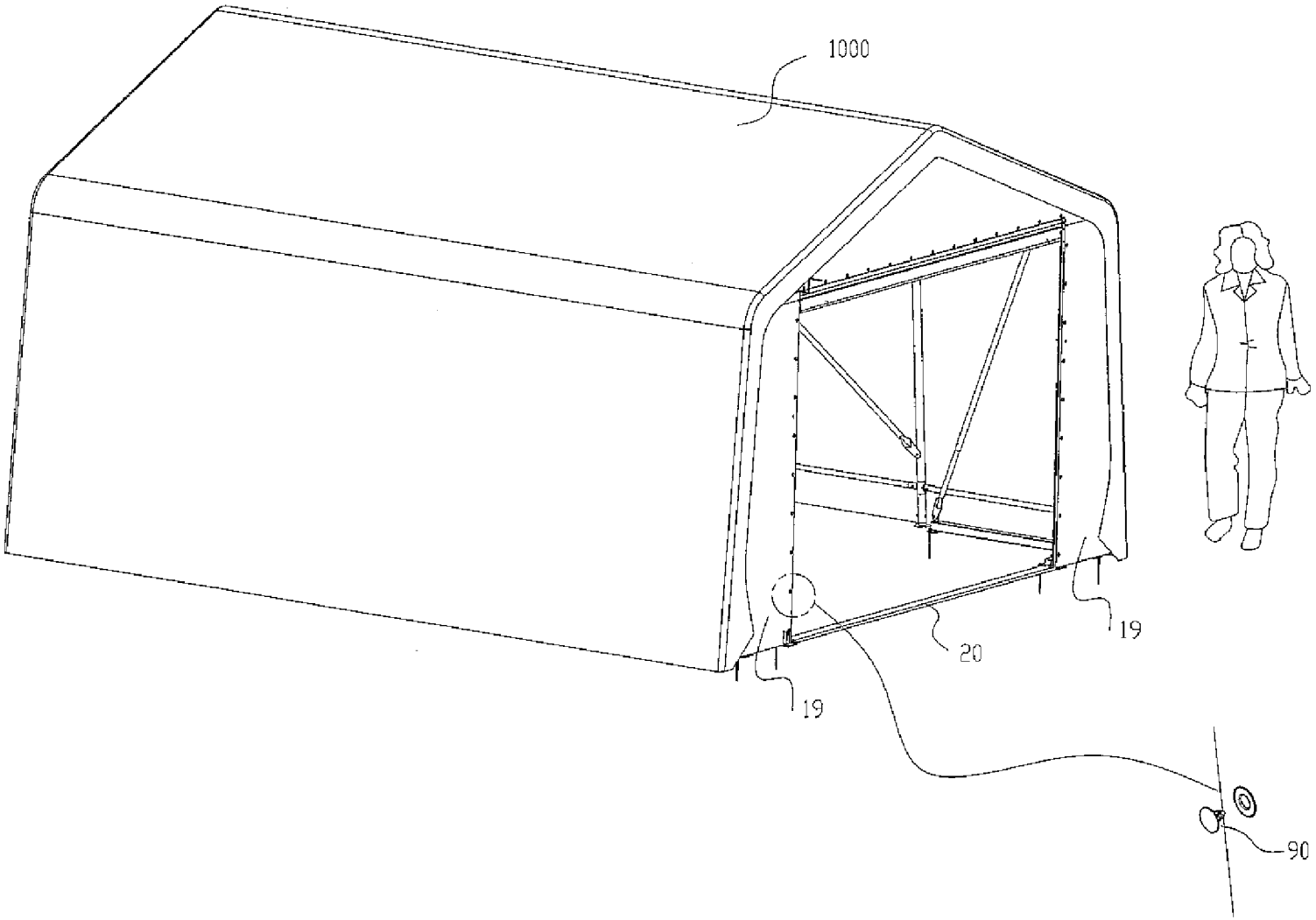
FIG. 2 is a perspective view of the combination shelter structure and door assembly constructed in accordance with a preferred embodiment of the present invention, having been covered by a cover and illustrating the door in almost a fully retracted position.

Reference is first made generally to FIGS. 1-2, which shows a door assembly, generally indicated at 10, constructed in accordance with a preferred embodiment of the present invention. As will become clear to the reader, the door assembly of the preferred embodiments herein is believed to be novel over door assemblies in the prior art, and is further particularly adapted for use in a shelter, an example of which is generally indicated at 100. The resulting shelter with door assembly is generally indicated at 1000. It should also be understood that while the shelter by itself need not be novel, its incorporation with a door assembly of the present invention does impart novelty to the combination as well. Therefore, it should be understood that the style, shape and size of the shelter itself is not material to the invention other than fact that the door assembly must be constructed to be fitted for use therewith. Moreover, as will further be understood, the present invention is usable with shelters of many styles, shapes and sizes as will be further discussed below.

Figures 3, 3A, 3B:
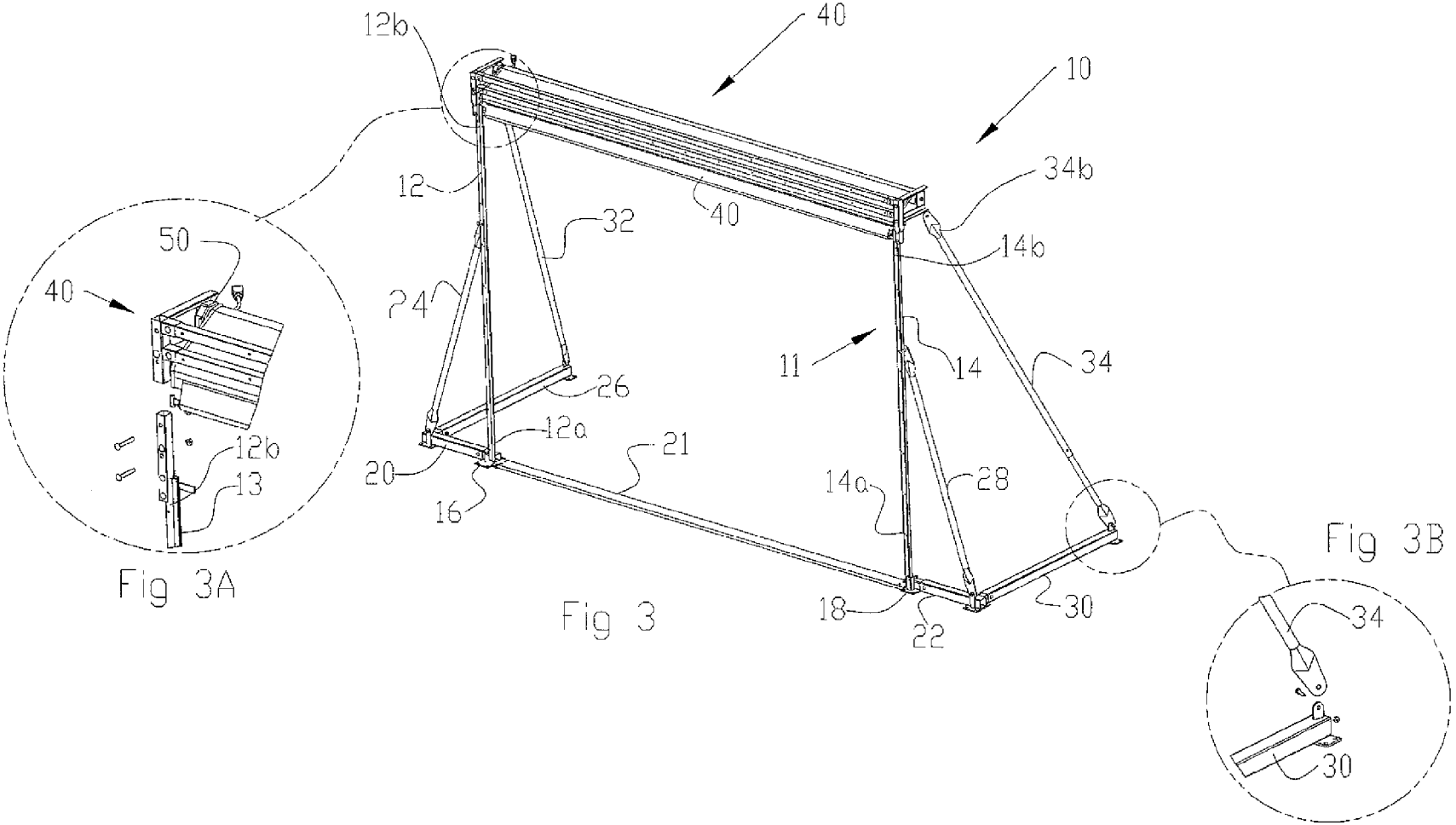
FIG. 3 is a perspective view of the door assembly constructed in accordance with a preferred embodiment of the present invention.
FIGS. 3A, 3B are perspective close up views of sections of the door assembly of FIG. 3.
Figures 4, 4A, 4B, 4C:
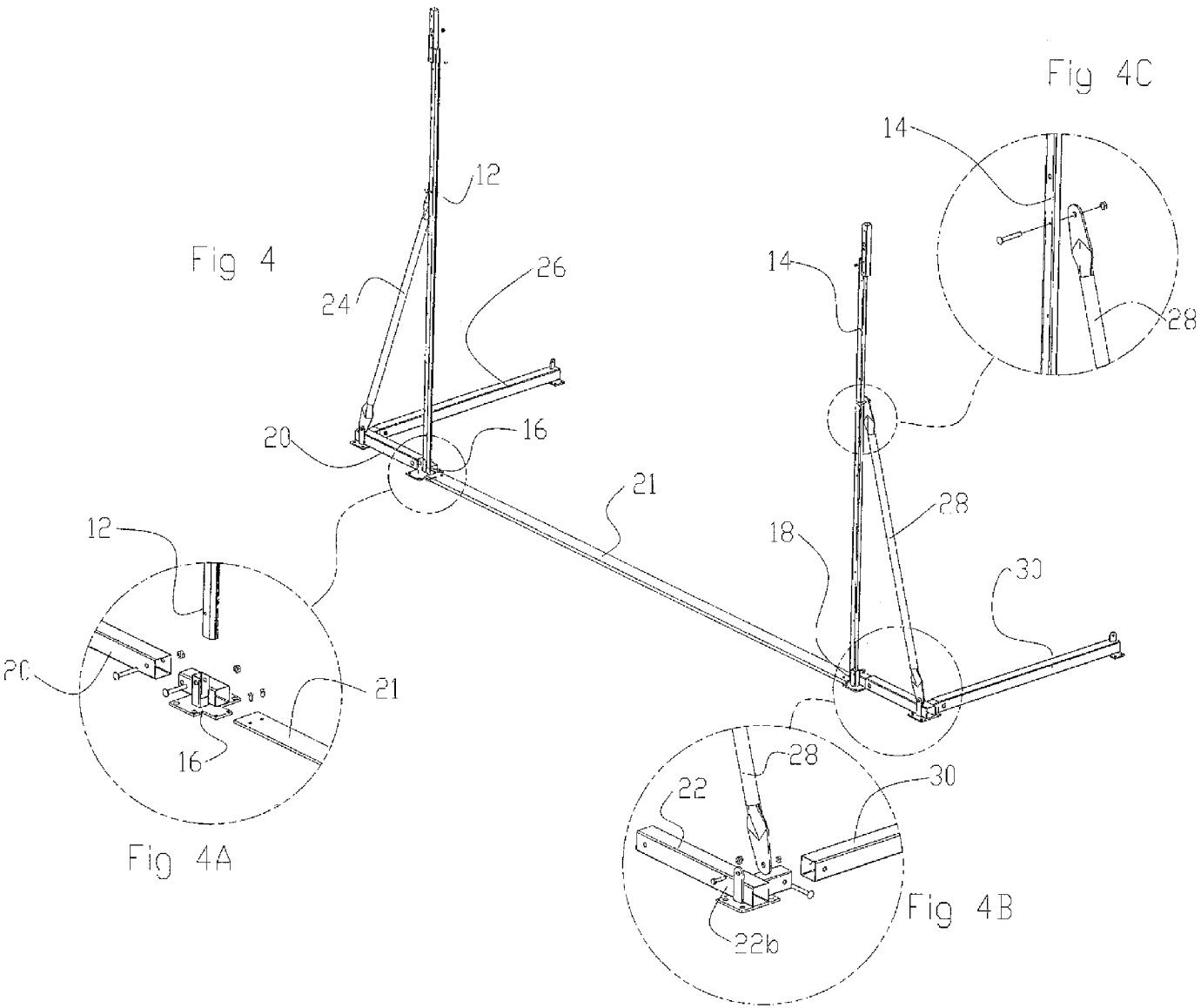
FIG. 4 is a perspective view of a portion of the door assembly of FIG. 3.
FIGS. 4A, 4B, 4C are perspective close up views of sections of the door assembly of FIGS. 3 and 4.

Turning therefore first to the particulars of a preferred embodiment of door assembly 10, reference is thus further made to FIGS. 3-5.

As illustrated, in the preferred embodiment, door assembly 10 comprises a door frame, generally indicated at 11, comprising a plurality of intercoupled members (as will be disclosed below) and a retractable door arrangement, generally indicated at 40, coupled to the door frame 11. As can be seen in the figures, the retractable door arrangement 40 comprises a door 42 comprised of a flexible material (e.g. polyethylene) that can be extended to enclose the shelter (e.g. as illustrated in FIG. 5) or retracted to provide an opening into the shelter (e.g. as illustrated in FIGS. 2-3). In a preferred embodiment, the plurality of members of door frame 11 may be intercoupled as follows:

Door frame 11 comprises a first upright 12 having a first end 12*a* and a second end 12*b* and a second upright 14 having a first end 14*a* and a second end 14*b*. Feet 16, 18 are respectively coupled to a respective first end 12*a*, 14*a* of each upright as would be understood by one skilled in the art from a review of FIG. 4A. To each foot 16, 18 is also coupled a respective extending support member 20, 22 for providing lateral support to door frame 11. Bolts/nuts and/or welding is the preferred means of connecting members, but other equally acceptable and adequate means are known and could be employed as would be understood in the art.

Door frame 11 also preferably comprises first side members 24, 26 and second side members 28, 30 also for providing stability and support to door frame 11. FIG. 4B illustrates in particular a preferred coupling arrangement of side members 28, 30 to end 22*b* of support member 22, and a identical arrangement may be provided on the opposite side of door frame 11 as would be understood in the art. Again, bolts/nuts and/or welding is the preferred means of connecting members, but other equally acceptable and adequate means are known and could be employed as would be understood in the art.

Lastly, an outrigger, such as those indicated by reference numbers 32, 34 may be respectively coupled to a rear end of each side member 26, 30 at one end and to retractable door arrangement 40 at the respective other ends thereof (see FIGS. 5, 5A, 5B). Side members 24, 28 may be coupled to their respective uprights as illustrated in FIG. 4C.

Reference is now also made to FIGS. 6, 6A, 7 and 8, which illustrate features of retractable door arrangement 40. In a preferred embodiment the roll of flexible (e.g. door) material 42 is preferably mounted on a spool, as would be understood in the art. In this way, the door can be extended off of the spool or retracted back onto the spool. A tube motor 50, preferably powered by conventional household voltage (i.e. AC) is provided, although battery power could be used with the proper power conversion circuits as would be understood by one skilled in the art. With the retractable door arrangement 40 mounted on respective ends 12*b*, 14*b* of the vertical uprights 12, 14 and coupled to the respective ends 32*b*, 34*b* of the outriggers 32, 34, the flexible material/door 42 can be "threaded" over an upper guide roller 47. The guide roller 47 is advantage because it facilitates in keeping the door aligned between the uprights and facilitates in keeping the door even on the spool as it is retracted onto or extended off of the spool.

Figure 7:
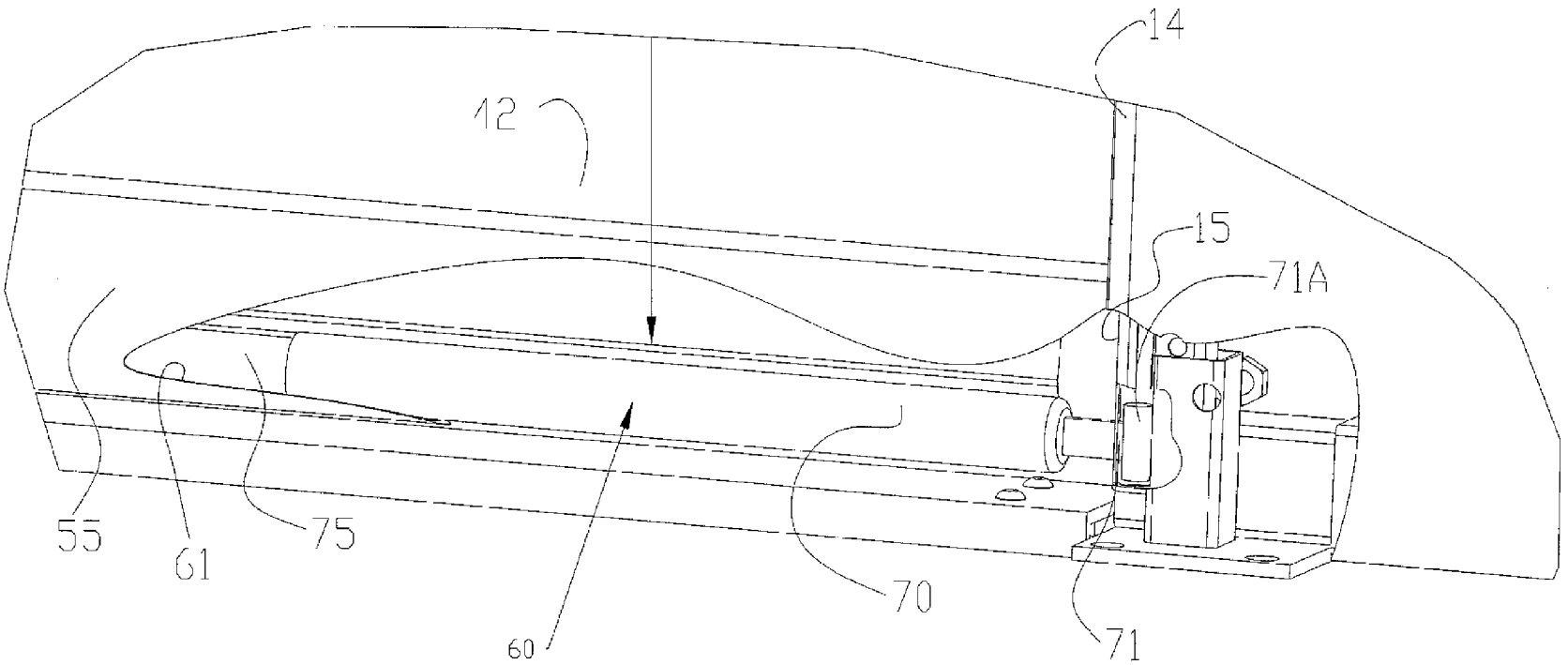
FIGS. 7, 8 are perspective views of sections of the door assembly constructed in accordance with a preferred embodiment of the present invention highlighting other features thereof.
Figure 8:
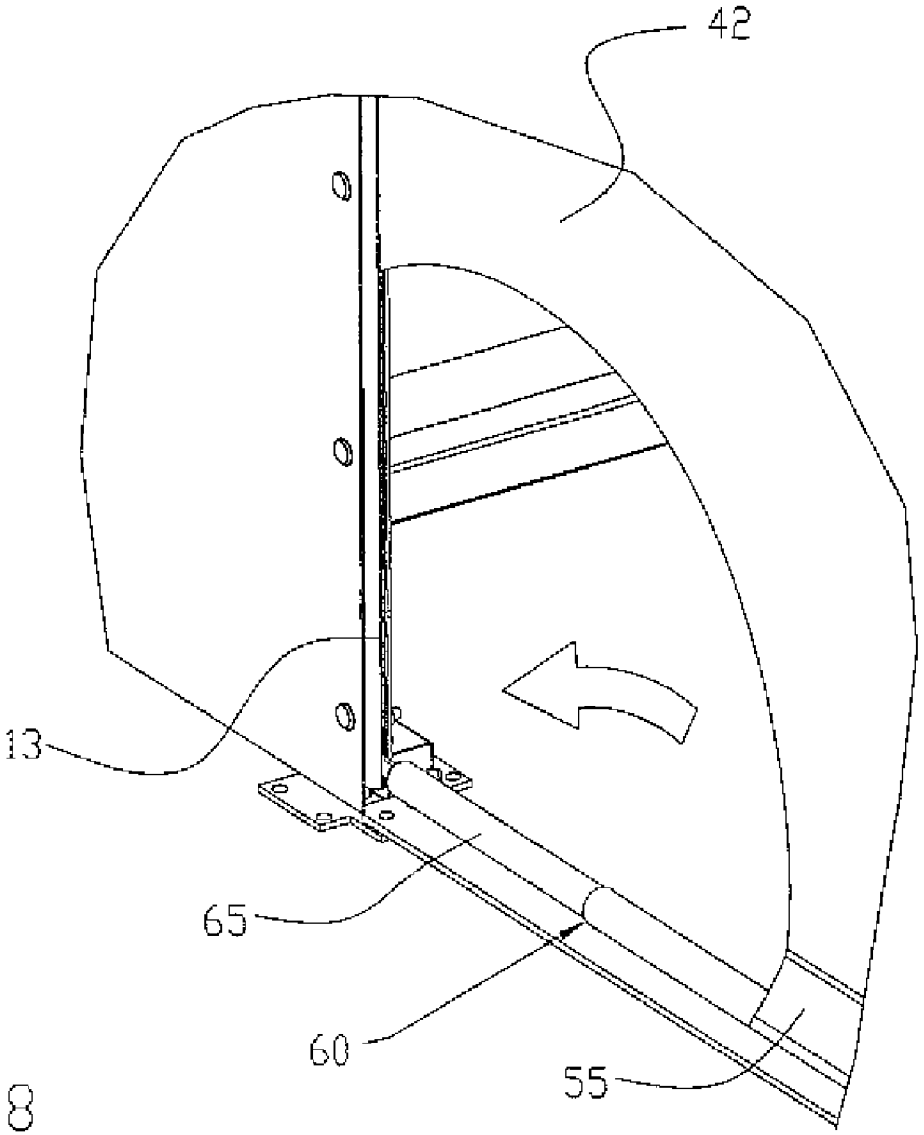

At an end 55 of the flexible material, an alignment rail assembly generally indicated at 60 is provided. Alignment rail assembly 60 may be provided in a sewn pocket 61 of the flexible material/door 42 as illustrated in FIG. 7.

Prior to discussing the particulars of alignment rail assembly 60, it is noted that in the preferred embodiment, the first upright 12 and the second upright 14 each have a respective channel 13, 15 the main purpose of which will now be explained.

That is, in the preferred embodiment, alignment rail assembly 60 has a first member 65 having a first end 66 that is insertable within the channel 13 of the first upright 12 and a second member 70 having a first end 71 insertable within the channel 15 of the second upright 14. As illustrated, the alignment rail assembly 60 is intermediate and slidable along the first upright 12 and the second upright 14. Preferably, first member 65 and second member 70 are separate pieces and slidable and independently rotatable within a sleeve 75. This way they are independently rotatable relative to each other. In this way, a significant advantage provided by the present invention is the ability to facilitate the extension and retraction of the door 42 even when the first upright 12 is out of the at least essentially vertical alignment with the second upright 14. That is, the independent rotation of the first and second members 65, 70 maintain the ability for the rail assembly 60 to easily slide within the uprights and as stated above, provide for the extension and retraction of the door 42 even when the first upright 12 is out of the at least essentially vertical alignment with the second upright 14. To this end, in a preferred construction, each end 66 and 71 may have a bulbous hand (the one most easily seen is hand 71*a*; the opposite hand at end 66 being of identical construction and shape), which is inserted in the top of respective ends 12*b*, 14*b* and is maintained therein by its large size compared to thin channels 13, 15. This way, assembly 60 cannot become prematurely or undesirably dislodged from the respective uprights 12, 14.

In a preferred embodiment, the retractable door arrangement 40 may include a handle 80 for manually retracting and extending the door 42. In a preferred embodiment, handle 80 may extend within the gear box of tube motor 50 to allow for manual extension or retraction of door 42. However yet advantageously, the use and positioning of handle 80 on the outside (as illustrated in FIG. 5) allows a user to be able to manually retract and extend the door 42 when the user is standing outside of the shelter (i.e. as in FIG. 2).

Figure 6:
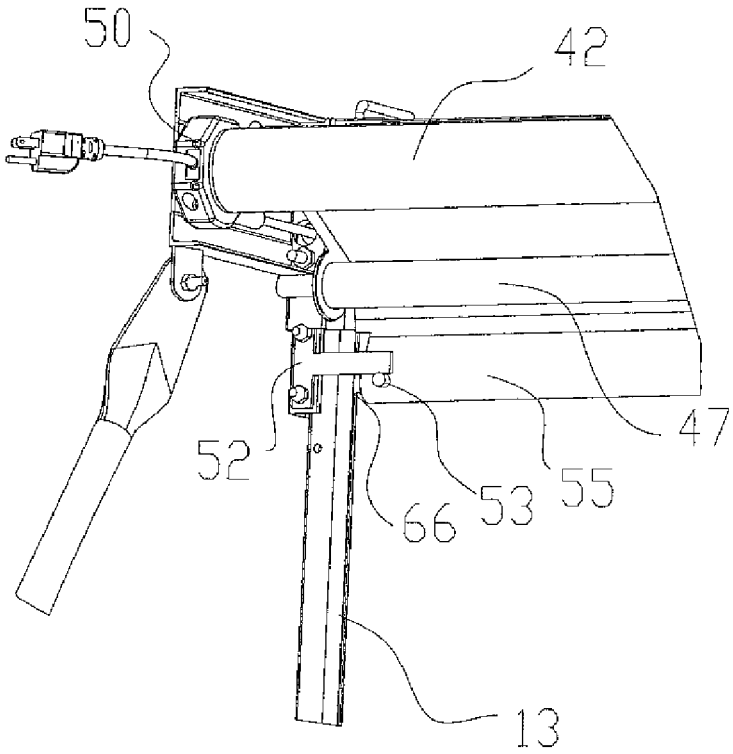
FIGS. 6, 6A are perspective views of sections of the door assembly constructed in accordance with a preferred embodiment of the present invention.
Figure 6A:
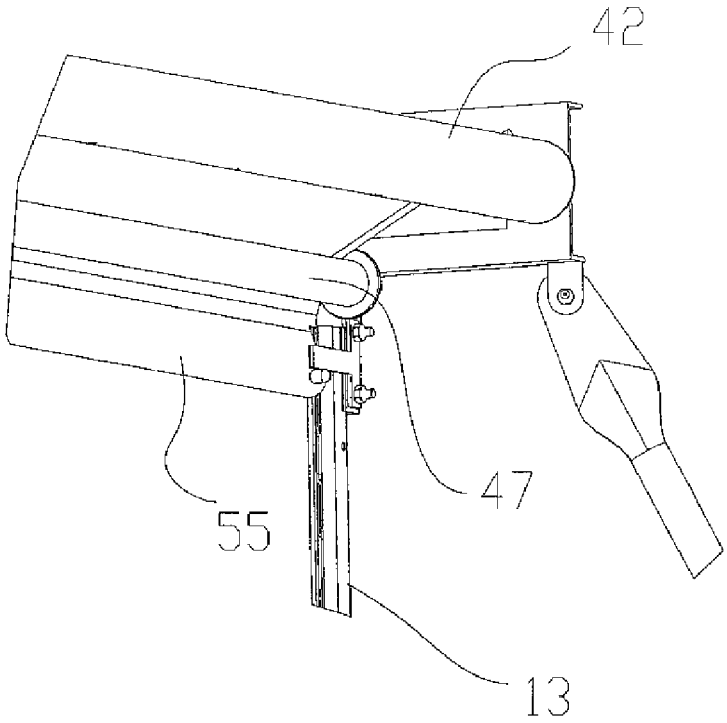

With reference made in particular to FIGS. 6, 6A a restraining plate 52 may be welded or otherwise coupled to either or both uprights, which, in combination with a tab 53 extending from the bottom of door 42, works to prevent the door from undesirably retracting too far upwardly.

Reference is now again briefly made to FIG. 1 in part for a disclosure of a shelter structure that can be easily utilized in combination with the door assembly of the present invention. However, and as indicated above, the particular style, shape and size of the shelter structure itself is not material to the invention, but only determines the design and size constraints to which a door assembly of the type disclosed herein must conform. Moreover, the present invention can be utilized with many styles, shapes and sizes of shelter structures so nothing herein should be construed in a limiting manner. For example, the shelter structures illustrated and described in U.S. Pat. No. 7,296,584, the subject matter of which is incorporated by reference as if fully set further herein, is an acceptable shelter structure that can be used in combination with the present invention.

The typical shelter structure may comprise (i) an outer frame assembly comprising a plurality of intercoupled members forming a coverable structure and (ii) a cover for covering the outer frame assembly, constructed in the following exemplary way and identified generally by reference number 100. In this example, shelter 100 may comprise a plurality of vertical post assemblies 110*a*, 110*b*, 110*c*, 110*d*, 110*e*, 110*f* each respectively coupled to one of a plurality of arch cross rail assemblies 120*a*, 120*b*, 120*c*, 120*d*, 120*e*, 120*f* via respective frame connectors 130*a*, 130*b*, 130*c*, 130*d*, 130*e*, 130*f*. The other end of each arch cross rail assembly may also be respectively coupled to a frame connector 140*a*, 140*b*, 140*c* (note that two arch cross rail assemblies are coupled to each one frame connector 140*a*, 140*b*, 140*c*). Horizontal cross rail assemblies 140*a*, 140*b*, 140*c*, 140*d*, 140*e*, 140*f* 140*a* are provided as well and are coupled to the arch cross rail assemblies via the frame connectors as illustrated and also as illustrated and described in the aforementioned '584 patent. Bottom cross rail assemblies 150*a*, 150*b*, 150*c*, 150*d* may also be provided as illustrated between the vertical posts for stability and structural integrity of shelter 100. As illustrated, it can be seen that frame connectors 130*a*, 130*c*, 130*d*, 130*f*, 140*a*, 140*c* are preferably three-way frame connectors while frame connectors 130*b*, 130*e*, 140*b* are preferably four-way frame connectors.

It should be understood that the respective vertical post assemblies, arch cross rail assemblies, horizontal cross rail assemblies and/or bottom cross rail assemblies may each be comprised as one elongated member or more than one member removably coupled, as illustrated and described in the aforementioned '584 patent.

Additional supporting members 155, 160 may also be added for additional support and structural integrity and connected by bolts and screws.

As also illustrated in the '584 patent and at least FIG. 2 herein, a tarp (or cover) for covering the frame of the peaked roof of shelter 100 is provided, and attaching it to vertical post assemblies, arch cross rail assemblies, horizontal cross rail assemblies, bottom cross rail assemblies and/or frame connectors may be achieved in a variety of ways, including but not limited to the use of bungee cords, tape, straps and/or loops, using connecting devices such as snaps, buttons, hook and pile, ties, or anything else within the skill of the artisan. Additionally, the use of c-clips can also be used to maintain the covering on shelter structure 100 by snapping the cover to the post therewith.

In the preferred embodiment coupling the panel 19 to the door assembly 10 is achieved using ribbed snap pins 90, such as those illustrated in FIG. 2, which may be used to hold the fabric panel 19 to assembly 10 through the use of grommets inserted into the panel for strength and ease of assembly. Similarly sized holes may be provided in the tubular members (e.g. uprights 12, 14 by way of example) as illustrated for the ribbed snap pins to be secured therein, thereby further assisting in maintaining the panel(s) thereon.

It can thus be seen that the present invention provides a novel door assembly for use in a shelter, wherein the shelter comprises an outer frame assembly comprising a plurality of intercoupled members forming a coverable structure and a cover for covering the outer frame assembly. In particular, and in accordance with the present invention, the door assembly does not rigidly connect to the outer frame assembly of the shelter during normal usage thereof. By "normal usage" it is intended to mean once the door assembly 10 and shelter structure 100 are constructed and covered so as to serve their intended purpose, namely to allow users to enter and exit the structure and be able to retract and extend the door.

Also, many other features are disclosed and claimed herein. For example, the claimed baseplate, indicated by reference number 21, which couples the respective bottom ends of the first upright and the second upright is flexible for assisting in maintaining at least essentially vertical alignment of the first upright relative to the second upright. By "at least essentially vertical upright," it is intended to mean that there is an understanding that the uprights may not be exactly (or maintained exactly) vertical but that there is a degree to which they may not exactly be 90° but still within the scope of the present invention. At least 80% vertical would clearly be within an acceptable range to achieve the objectives set forth herein and carry out the present invention. The foregoing is also equally applicable for the alignment rail assembly, whose first and second members are independently rotatable relative to each other thereby facilitating the extension and retraction of the door even when the first upright is out of the at least essentially vertical alignment with the second upright.

To be sure, the present invention is also directed to a shelter system comprising an outer frame assembly comprising a plurality of intercoupled members forming a coverable structure; a cover for covering the outer frame assembly, a door frame comprising a plurality of intercoupled members; and a retractable door arrangement coupled to the door frame, wherein the retractable door arrangement comprises a door comprised of flexible material that can be extended to enclose the shelter or retracted to provide an opening into the shelter; wherein the door assembly does not rigidly connect to the outer frame assembly of the shelter during normal usage thereof.

As would be known in the art and to the extent not dictated by function but rather by design constraints, combinations of metal, steel and/or plastic pieces may be used for the components disclosed herein. Preferably, however, all tubing is made of steel.

It can thus be seen that the present invention is advantageous and overcomes the perceived deficiencies in the prior art. For example, the present invention reduces and/or eliminates the problem of twisting and/or torquing of the door assembly, thereby improving the ability of the door to retract and/or extend efficiently and properly. Additionally, the present invention can be used on a variety of ground conditions, such as during winter and/or on less than perfectly flat ground. Moreover, the present invention is easy to assemble. Further, the present invention can be retracted or extended during a power outage. Still further, the present invention is durable and provides for improved stability and structural integrity. Yet further, it is relatively quick to assemble and disassemble as well as utilize and manufacture, while at the same time, achieving the other objectives set forth herein.

To this end, it can be seen that a method of constructing a door assembly for shelter structures and shelter structures including such a door assembly is provided.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It should also be understood that the following claims are intended to cover all of the generic and specific features of the invention described herein and all statements of the scope of the invention that as a matter of language might fall there between.

What is claimed is:

1. A door assembly for use with a shelter, wherein the shelter comprises an outer frame assembly comprising a plurality of intercoupled members forming a coverable structure and a cover for covering the outer frame assembly, wherein the door assembly comprises:

a door frame comprising a plurality of intercoupled members, wherein one of the intercoupled members of the door frame is a first upright having a first end and a second end and wherein another of the intercoupled members of the door frame is a second upright having a first end and a second end, wherein the first upright and the second upright each have a channel;

a retractable door arrangement coupled to the door frame, wherein the retractable door arrangement comprises a door comprised of flexible material that can be extended to enclose the shelter or retracted to provide an opening into the shelter, and wherein the retractable door arrangement comprises an alignment rail assembly having a first member having a first end insertable within the channel of the first upright and a second member having a first end insertable within the channel of the second upright and wherein the alignment rail assembly is intermediate and slidable along the first upright and the second upright; and wherein the first member and the second member are independently rotatable relative to each other thereby facilitating the extension and retraction of the door even when the first upright is out of the at least essentially vertical alignment with the second upright.

2. The door assembly as claimed in claim 1, wherein the door frame is shiftable independently of the outer frame assembly.

3. The door assembly as claimed in claim 1, wherein the door frame comprises:

a baseplate coupling the respective bottom ends of the first upright and the second upright;

wherein the baseplate is flexible for assisting in maintaining the at least essentially vertical alignment of the first upright relative to the second upright.

4. The door assembly as claimed in claim 1, including an upper guide roller, wherein the door extends over the upper guide roller as it is extended or retracted.

5. The door assembly as claimed in claim 4, wherein the retractable door arrangement includes a handle for manually retracting and extending the door.

6. The door assembly as claimed in claim 5, wherein the handle is positioned on the side of the door assembly such that when the door assembly is used with the shelter during normal usage, a user can manually retract and extend the door when the user is standing outside of the shelter.

7. The door assembly as claimed in claim 4, wherein the retractable door arrangement includes a tube motor for retracting and extending the door.

8. The door assembly as claimed in claim 1, wherein the door assembly does not rigidly connect to the outer frame assembly of the shelter during normal usage thereof.

9. A shelter system comprising:

an outer frame assembly comprising a plurality of intercoupled members forming a coverable structure;

a cover for covering the outer frame assembly, a door frame comprising a plurality of intercoupled members, wherein one of the intercoupled members of the door frame is a first upright having a first end and a second end, and wherein another of the intercoupled members of the door frame is a second upright having a first end and a second end, wherein the first upright and the second upright each have a channel; and a retractable door arrangement coupled to the door frame, wherein the retractable door arrangement comprises a door comprised of flexible material that can be extended to enclose the shelter or retracted to provide an opening into the shelter, and wherein the retractable door arrangement comprises an alignment rail assembly having a first member having a first end insertable within the channel of the first upright and a second member having a first end insertable within the channel of the second upright and wherein the alignment rail assembly is intermediate and slidable along the first upright and the second upright; and wherein the first member and the second member are independently rotatable relative to each other thereby facilitating the extension and retraction of the door even when the first upright is out of the at least essentially vertical alignment with the second upright.

10. The shelter system as claimed in claim 9, wherein the foor frame is shiftable independently of the outer frame assembly.

11. The shelter system as claimed in claim 9, wherein the door frame comprises:

a baseplate coupling the respective bottom ends of the first upright and the second upright;

wherein the baseplate is flexible for assisting in maintaining the at least essentially vertical alignment of the first upright relative to the second upright.

12. The shelter system as claimed in claim 9, including an upper guide roller, wherein the door extends over the upper guide roller as it is extended or retracted.

13. The shelter system as claimed in claim 12, wherein the retractable door arrangement includes a handle for manually retracting and extending the door.

14. The shelter system as claimed in claim 13, wherein the handle is positioned on the side of the door assembly such that when the door assembly is used with the shelter during normal usage, a user can manually retract and extend the door when the user is standing outside of the shelter.

15. The shelter system as claimed in claim 9, wherein the retractable door arrangement includes a tube motor for retracting and extending the door.

16. The door assembly as claimed in claim 9, wherein the door assembly does not rigidly connect to the outer frame assembly of the shelter during normal usage thereof.

* * * * *